US008416645B2

(12) United States Patent
Zaugg et al.

(10) Patent No.: US 8,416,645 B2
(45) Date of Patent: Apr. 9, 2013

(54) TIME ZONE ON DEMAND ON THE MAIN HANDS OF A TIMEPIECE

(75) Inventors: Alain Zaugg, Le Brassus (CH); Olivier Karlen, Blonay (CH); Christophe Bifrare, Le Pont (CH)

(73) Assignee: Montres Breguet SA, L'Abbaye (CH)

( * ) Notice: Subject to any disclaimer, the term of this patent is extended or adjusted under 35 U.S.C. 154(b) by 198 days.

(21) Appl. No.: 13/035,057

(22) Filed: Feb. 25, 2011

(65) Prior Publication Data

US 2011/0205852 A1 Aug. 25, 2011

(30) Foreign Application Priority Data

Feb. 25, 2010 (EP) ..... 10154623

(51) Int. Cl.
*G04B 19/22* (2006.01)

(52) U.S. Cl.
USPC ..... 368/22; 368/220

(58) Field of Classification Search ..... 368/22, 368/220, 21, 106
See application file for complete search history.

(56) References Cited

U.S. PATENT DOCUMENTS

| | | | | |
|---|---|---|---|---|
| 2,058,712 | A * | 10/1936 | Muir et al. | 368/112 |
| 2,325,539 | A * | 7/1943 | Pfister | 368/106 |
| 2,789,410 | A | 4/1957 | Bridevaux | |
| 3,811,019 | A | 5/1974 | Solari | |
| 3,890,779 | A * | 6/1975 | Capt et al. | 368/103 |
| 3,940,761 | A | 2/1976 | Arai | |
| 5,285,427 | A | 2/1994 | Vaucher | |
| 5,793,708 | A * | 8/1998 | Schmidt et al. | 368/106 |
| 6,428,201 | B1 * | 8/2002 | Shibuya et al. | 368/106 |
| 7,539,084 | B2 | 5/2009 | Berseth | |
| 2004/0037171 | A1 | 2/2004 | Meis | |
| 2005/0249043 | A1 | 11/2005 | Bobe et al. | |
| 2007/0002690 | A1 * | 1/2007 | Rochat | 368/28 |
| 2007/0091727 | A1 | 4/2007 | Bonvin et al. | |

(Continued)

FOREIGN PATENT DOCUMENTS

| | | |
|---|---|---|
| CH | 683 055 A5 | 1/1994 |
| CH | 685 965 A3 | 11/1995 |

(Continued)

OTHER PUBLICATIONS

Notice of Allowance issued in co-pending U.S. Appl. No. 13/034,070 on Oct. 22, 2012.

(Continued)

*Primary Examiner* — Sean Kayes
(74) *Attorney, Agent, or Firm* — Griffin & Szipl, P.C.

(57) ABSTRACT

The invention concerns a mechanism (100) for displaying, on demand, the time in a time zone, on the hands of a timepiece. It is characterized in that it includes:

two memory wheels (30), each including a heart-piece (40) that pivots relative to a toothed wheel (31) between indexing positions (34) thereon, with which it cooperates via a finger-piece (41) radially returned to said positions by a spring (43), support means (50), which, between two actions by the user, connectably cooperates with a support surface (45) of a memory wheel (30) and is then disconnected from a support surface (45) of the other memory wheel (30), a differential gear (12) with a first input formed by a motion work wheel set, a second input formed by a crown (12A) of said differential gear (12) with which each memory wheel (30) meshes, and an output consisting of an hour hand (25).

The invention concerns a timepiece incorporating a mechanism (100) of this type.

13 Claims, 11 Drawing Sheets

U.S. PATENT DOCUMENTS

| | | | |
|---|---|---|---|
| 2008/0093435 | A1 | 4/2008 | Berseth |
| 2008/0205200 | A1 | 8/2008 | Spode et al. |
| 2009/0086583 | A1 | 4/2009 | Wyssbrod |
| 2009/0310445 | A1 | 12/2009 | Laucella et al. |

FOREIGN PATENT DOCUMENTS

| | | | |
|---|---|---|---|
| CH | 693 155 | A5 | 3/2003 |
| CH | 693 292 | A5 | 5/2003 |
| EP | 0 570 856 | A1 | 11/1993 |
| EP | 1 306 734 | A2 | 5/2003 |
| EP | 1 873 696 | A1 | 1/2008 |
| EP | 1 959 317 | A1 | 8/2008 |
| EP | 2 136 271 | A1 | 12/2009 |
| FR | 2 158 532 | | 11/1972 |
| FR | 2 254 820 | | 7/1975 |
| WO | 2007/115984 | A2 | 10/2007 |

OTHER PUBLICATIONS

Search Report issued in the corresponding European application EP 10 15 4623, completed Aug. 13, 2010.

* cited by examiner

TIME ZONE ON DEMAND ON THE MAIN HANDS OF A TIMEPIECE

This application claims priority from European Patent Application No. 10154623.2 filed Feb. 25, 2010, the entire disclosure of which is incorporated herein by reference.

FIELD OF THE INVENTION

The present invention concerns a time zone mechanism, arranged for displaying, on demand, the time in a particular time zone, on the main hands of a timepiece that includes a movement with a going train.

The invention also concerns a timepiece incorporating a mechanism of this type.

The invention concerns the field of watchmaking, notably timepiece mechanisms that can be integrated in watches, and more specifically, the particular field of timepiece displays.

STATE OF THE PRIOR ART

The invention sets out to solve the problem of displaying dual time zones, on demand, on the main hands.

The main problem of on-demand display is above all the problem linked to the instantaneousness of the desired result, which is further complicated when, as in this case, one wishes the display to be on the centre hands of a timepiece, particularly a watch. Indeed, data stored in mechanical form has to be instantaneously available. Evidently, the user should be offered the possibility of easily changing the setting(s) stored in the memory.

It is known that purely mechanical data storage is ill suited to the reduced space available in a portable timepiece such as a watch, and that only a few masterpieces in the history of watchmaking have included memory mechanisms, which are inaccessible to industrial production.

Mechanical memories in the form of perforated or machined discs or cards are known, for example including areas with teeth alternating with areas with no teeth, or even grooves or stop members of different lengths. These devices are perfectly reliable, but once made they are unalterable. The only way to alter the adjustment data that these mechanical memories contain is to change them completely and replace them with another similar support, including different adjustment data.

Devices with stop members or levers for changing position are also known, which generally only allow a restricted number of settings to be adjusted, and the reliability of which over time is not ideal.

Other systems with rotating drums, such as that disclosed in FR Patent No. 2 158 532 in the name of Solari & C, for changing the day indication and adjusting the date by increment, are adjusted with the insertion of combs which may or may not have teeth in different positions, but the use thereof requires pre-adjustment as for similar systems used on machine-tools, automatic lathes or suchlike, and these systems cannot be reprogrammed in the mechanism in which they are incorporated. In a similar but simplified manner, a device is known from FR Patent No 2 254 820 in the name of the Copal Company Ltd, which incorporates several memory wheels cooperating with each other and fitted with cams or cam portions.

There is also known from CH Patent No 693 292 in the name of Antonia Dolcet Cavero, a perpetual calendar mechanism which, in a timepiece application, integrates memory wheels, which include a certain number of cut out portions on the external or internal periphery of a disc or a ring, which have variable widths and depths and correspond, for example, on a day of the month wheel, to changes in the tens of days and to the 29th, 30th, 31st days of the month. Some of these cut out portions, particularly the last one in the preceding example, which is wide and tiered, can be entirely or partially concealed by a mobile screen under the action of a cam or suchlike. However, the concealing mechanism is cumbersome, which means that only very few positions can be stored.

CH Patent No 693 155 in the name of STREHLER Andreas discloses a switchable display mechanism for displaying two different pieces of information with the same hand. A heart-piece integral with a planet wheel holder for a planetary gear is provided for analogically storing the difference between the values of the two pieces of information. A first input of this planetary gear is connected to the hand; the second input is driven in order to represent the value of the second piece of information. The position of the planet wheel holder, at the exit of the differential gear, represents the difference between the values of the two pieces of information. When the display mechanism is switched to the second piece of information, the kinematic link between the first piece of information and the hand is uncoupled and a hammer is simultaneously lowered against the heart-piece to cause it to pivot with the planet wheel holder into a zero angular position, the second display is maintained as long as the hammer is abutting against said wheel. The movements of the second differential input wheel are then transmitted to the hand whose position changes in accordance with the value of the second piece of information. A second heart-piece with a second hammer forms the link that can be uncoupled between the first piece of information and the hand. This device is complex and expensive for handling time zones between which the time difference does not vary over time.

WO Patent No 2007/115984 in the name of FREDERIC PIGUET, SA is also known, which discloses a mechanism for storing a time difference between two time zones, and switching display means to indicate the time in one or other of these time zones. This mechanism includes a heart-piece that is mobile in rotation and linked to time display means via a kinematic chain, and cooperates selectively with one or other of two levers each corresponding to the display of one of the time zones, the switching is manual, and the time difference between the time zones is determined by the relative position of one lever with respect to the other. The heart-piece is asymmetrical, and it completes one revolution in 48 hours. Control means are provided for adjusting the time difference between the time zones by altering the position of at least one of the levers around the heart-piece.

EP Patent No 2 136 271 in the name of MONTRES BREGUET discloses a display mechanism for displaying one or two different indications with the same indicating member. It includes a rotating analogue indicator member, first and second counter wheel sets whose positions are representative of two magnitudes to be displayed by the indicator member, and a manual switching mechanism for displaying the first or second magnitude. The switching mechanism includes a rotating arbour kinematically connected to the indicator member, and a sliding wheel set secured to said arbour in rotation, and sliding under the action of the manual control device, so as to occupy selectively a first or second position on the arbour, in which the sliding wheel set meshes respectively with the first or second counter wheel set.

EP Patent No. 1 1959 317 in the name of MAURICE LACROIX SA proposes a switchable mechanism including a transmission pinion driven by a first wheel set and representing a first piece of information to be displayed. A element carrying a first fly back hand heart-piece is freely mounted on the pinion, and driven by the first wheel set or by a second wheel set representing a second piece of information. A second fly back hand heart-piece is fixed to this transmission pinion, and carries a first/second hammer pre-stressed by a first/second spring against the first/second heart-piece. A switching wheel is rotatably mounted on the periphery of the transmission wheel. It carries a first/second cam acting on the first/second hammer to remove alternately the contact between the first/second hammer and the first/second heart-piece, so as to switch the position of the transmission wheel according to the first/second piece of information to be displayed. An intermediate control wheel is freely mounted about the transmission pinion, and meshes with the switching wheel. This intermediate control wheel is fixed to a control wheel that can be rotated in a controlled manner via a control mechanism of the transmission mechanism.

In short, few purely mechanical solutions exist which are well suited to the problem, not only of data storage, but also of reprogramming a device by selecting a stored setting, or by creating a new setting, within the compact space available in a timepiece mechanism. The problem is all the more acute when a certain quantity of settings are provided, which is common in a timepiece where it is desired to adjust discrete settings, such as the days of the month, the months of the year, time zones, astronomic or zodiacal phases, for example.

The invention sets out to solve the problem of making a programmable mechanical memory that can be reprogrammed by the user, and particularly by the final user of a timepiece movement, such as the person wearing a watch. In short, it is a matter of being able to store easily adjustments performed by the user, in a very reliable and accurate manner.

One of the applications that has provided a good solution to this problem is known from EP Patent No. 1 873 696 in the name of Swatch Group Research & Development. Ltd, disclosing a golf counter, devised to be integrated in a mechanical watch, which enables the user to store mechanically the scores achieved at each hole of a golf course. This counter has as many wheel sets as there are holes in a golf course, and each wheel set can occupy different angular positions depending upon the number of strokes played at each hole. Separate windows show the hole number displayed on a movable plate, the score of the hole being played displayed on a disc driven by a pinion, and the accumulated score for all the holes played displayed on a totaliser driven by an ad hoc star-wheel. To store the number of strokes played at each hole, each time a stroke is played, the user actuates an increment push-button causing a lever to tip, which triggers the pivoting of an increment wheel set, which drives, on the one hand, a pivoting star-wheel retained by a jumper spring and integral with an absolute origin heart-piece and a snail of decreasing radius, and on the other hand, the totaliser star-wheel. A pivoting rack lever is returned towards the path of the snail, whose decreasing shape allows the rack limited rotation, which causes the score disc carrier pinion of the hole being played to rotate. Repeated applications of pressure change the score, and the user also has a push-button for a reverse decrement movement. Pulling on a control member allows the user to change to the next hole of his golf course, via the movement of a special cam which releases the rack lever from the snail, and rotates the movable plate displaying the next hole. The score is reset to zero via action on a lever actuating a toothed crown which realigns all the heart-pieces of all the wheel sets into an original position. Until the user has performed this reset, he can recall each of the holes to consult his score, via action on the control member, since the position of each wheel set is stored by a jumper spring. Naturally, these jumper springs are indispensable, at a rate of one per wheel set, and the entire mechanism requires a certain volume.

The storage performed by this type of device is efficient, and it offers easy return to the stored information, without, however, making it immediately available, for example simply by a single application of pressure on a push-button. Further, this device is not especially designed for display on the main hands, with which it does not interfere.

There is known, from CH Patent No. 683 055 in the name of the Compagnie des Montres Longines, Francillon SA, a timepiece whose time display can be independently altered, in particular in the event of a change to another time zone. The hour hand is driven onto an inner pipe of the hour-wheel which serves as a pivot for an outer hour-wheel pipe carrying a correction wheel which drives the drive rollers each having a degree of radial freedom, and which are returned, together, by elastic return means, in cooperation with a star-wheel. The star-wheel is integral with a bottom hour-wheel, which is meshed with the motion work and which rotates freely relative to the inner pipe carrying the hand. The correction wheel meshes with a correction mechanism of the movement. This device allows the time display to be changed simply, inexpensively and can be adapted to any existing movement. However, it does not have a mechanical memory for storing certain settings, and cannot guarantee immediate access to another time zone display, but only via a series of impulses.

Similarly, from CH Patent No 685 965 in the name of Ulysse Nardin SA, there is also known a timepiece whose hour hand can be moved forwards or backwards in one hour steps. The hour hand is fitted onto a pipe that rotates freely around a cannon-pinion. This pipe is integral with a correction star-wheel. Two levers, each controlled by a push-button act on the teeth of the correction star-wheel. An hour wheel driven by a motion work and pivoting freely about the pipe is coupled to this correction star-wheel by a jumper mechanism. When the correction star-wheel is driven by one of the push-buttons, this jumper mechanism can uncouple the movable pipe relative to the fixed hour wheel, and the pipe and hour hand, whereas the hour wheel is not driven since it is retained by the movement. In the absence of any action on one of the push-buttons, the jumper mechanism behaves like a rigid coupling. An auxiliary wheel is integral with a correction star-wheel, and drives a date disc via an intermediate wheel set. Each action on a push-button causes the hour hand to jump one hour. The date disc is still blocked in or phase with the hour hand. A twenty-four hour disc enables another time zone to be displayed, different from the set of hands that displays the local time, or at least a reference time selected by the user by action on the push-buttons. This document thus discloses a method of quickly changing the position of the hour hand in one hour steps. However, there does not appear to be any possibility of storing another time zone, or of the display jumping several hours at a time.

The teaching of these various Patent documents proposes partial solutions to the problem raised, and the proposed mechanisms are too different from each other for those skilled in the art to reasonably be able to combine them or even juxtapose them to obtain an intermediate solution.

SUMMARY OF THE INVENTION

In order to resolve the problem of displaying dual time zones on demand, and instantaneously, on the main hands, while allowing the user to easily change the setting(s) stored in the memory by reprogramming, in a very reliable and accurate manner, the present invention concerns a time zone mechanism, arranged for displaying, on demand, the time in a particular time zone, on the main hands of a timepiece including a movement, characterized in that it includes:

at least two programmable and reprogrammable memory wheels, each including, on the one hand, a wheel including means for driving in rotation about an axis of rotation, and on the other hand, a reversibly movable heart-piece pivoting between indexing positions of said wheel, support means arranged for disconnectably cooperating with a support surface comprised in each said memory wheel, and, between two actions by the user, connectably cooperating with said support surface of one of said memory wheels, and then being disconnected from said support surface of the other said memory wheel, a differential gear with two inputs and one output, a first input being formed by a motion wheel set arranged to be driven by said movement, a second input being formed by a crown of said differential gear, and said output consisting of a cannon-pinion or an arbour carrying an hour hand, each of said memory wheels meshing via said drive means, directly or indirectly with said differential crown.

According to one feature of the invention, said support means are formed by a hammer arranged to pivot between at least two positions, one abutting said heart-piece support surface one of said memory wheels, and other abutting said heart-piece support surface of the other said memory wheel.

According to another feature of the invention, the mechanism includes a push-button arranged for actuating a lever via an application of pressure by the user. The lever is permanently returned towards an idle start position by a lever spring, and carries a pivoting navette that is returned towards an initial position under the action of a compensator spring and which is arranged for cooperating with said hammer by abutting on one or other of two pins comprised in the hammer to pivot said hammer towards one of said memory wheels. Said mechanism includes a jumper spring arranged for locking said hammer in position after pivoting until the next action on said push-button, which will trigger cooperation of said navette with the other said pin, to pivot said hammer towards the other said memory wheel.

The invention also concerns a timepiece incorporating a mechanism of this type.

The invention provides numerous advantages: it enables a time zone watch to be made very simply with optimum readability, both as regards reading the reference time or current time in the place where it is used, and reading the time in the time zone desired by the user.

The timepiece dial maintains its simplicity, although the function is technically complicated. This display function by the main hands is original, and provides an undeniably attractive feature for the user.

The solution proposed by the solution is also applicable to the display of other time related, astronomical or other magnitudes, and indeed, the invention is remarkable for its versatility and the range of solutions that it offers those skilled in the art experiencing similar problems.

DESCRIPTION OF THE DRAWINGS

Other features and advantages of the present invention will appear more clearly from the following detailed description of one embodiment of the watch according to the invention, this example being given solely by way of non-limiting illustration with reference to the annexed drawings, in which.

DETAILED DESCRIPTION OF THE INVENTION

Figure 1:
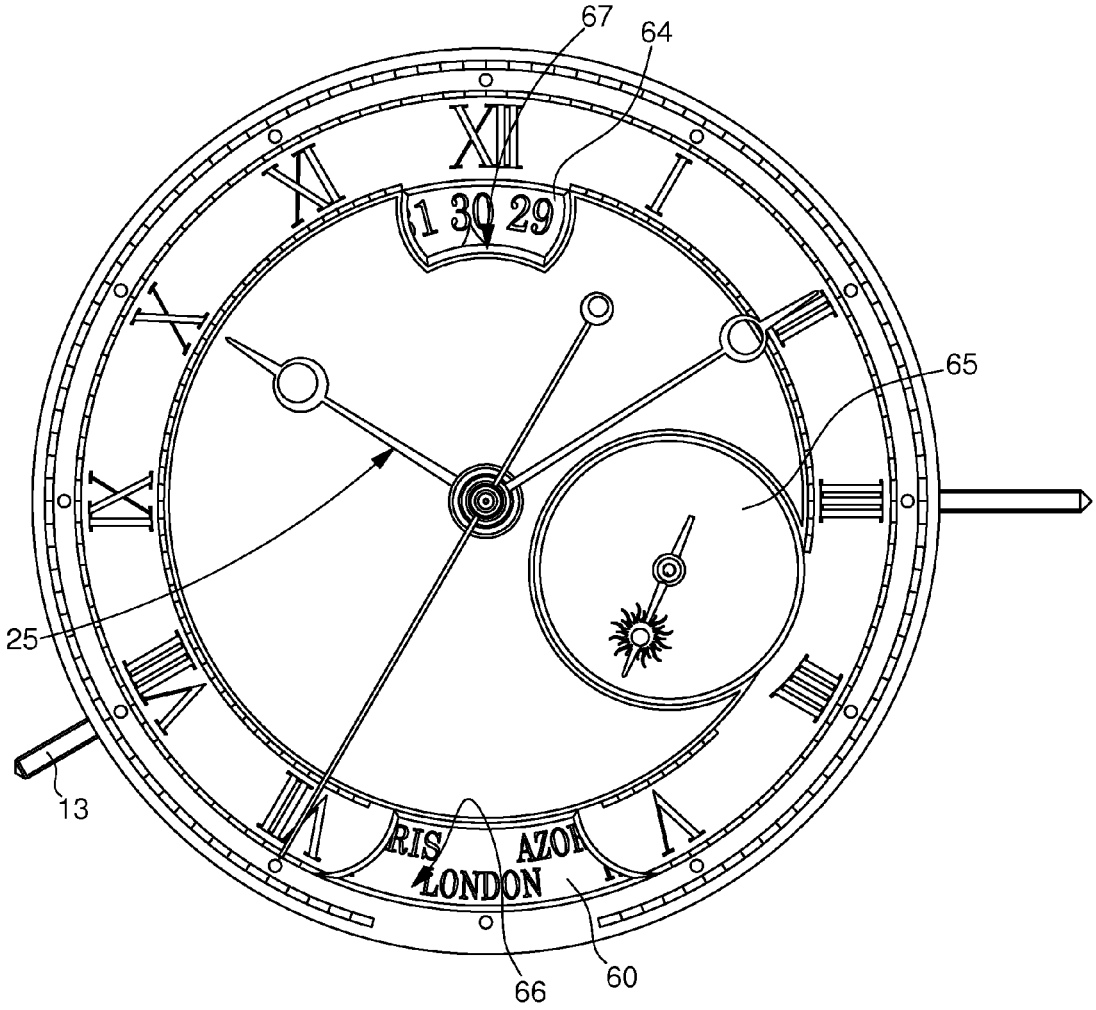
FIG. 1 shows schematically in a plan view, a watch incorporating a time zone mechanism according to the invention, in a first embodiment.

The invention concerns the field of timepieces displays.

The present invention concerns a timepiece mechanism which is firstly arranged for storing settings selected by a user.

In particular, the invention is described in a preferred, but non-limiting application of a time zone mechanism, which is arranged for the on-demand and instantaneous display of the time in a particular time zone, on the main hands of a timepiece. This mechanism will be described in a preferred embodiment, with an indication of the 24 time zones, with a dual time zone on the main hands, date indication and 24 hour day-night indication.

According to the invention, this mechanism is based on the use of at least one memory wheel, which forms a physical support for the mechanical storage of a particular setting, and which can be programmed and reprogrammed by the user, without being dismantled.

This memory wheel 30 for a timepiece mechanism includes a wheel 31 which includes means 36 for rotational driving about an axis of rotation 33. In a preferred but non-exclusive embodiment, this wheel 31 is toothed and includes a toothing 32, which forms rotational drive means 36. In the particular application of FIG. 6, this toothing 32 is external, but the invention is applicable in the same manner if toothing 32 is internal, or even bell shaped or other. Remaining within the spirit of the invention, drive means 36 may be formed by a groove or suchlike for supporting a drive belt, or a chain, or suchlike, or spikes or suchlike, or a wheel including a friction surface for driving the wheel.

Figure 4:
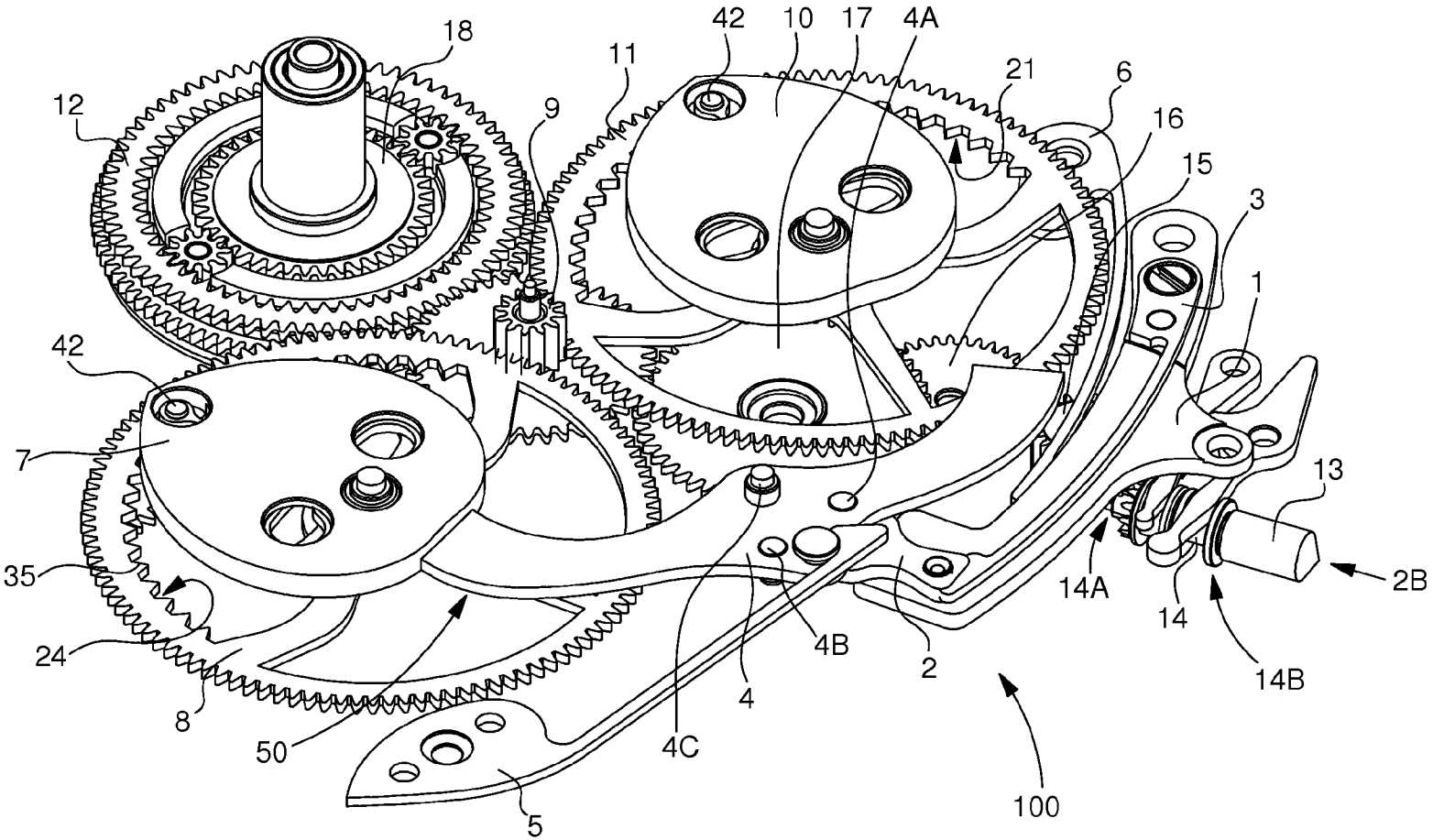
FIG. 4 shows, schematically, partially and in perspective, a time zone mechanism according to the invention.
Figure 5:
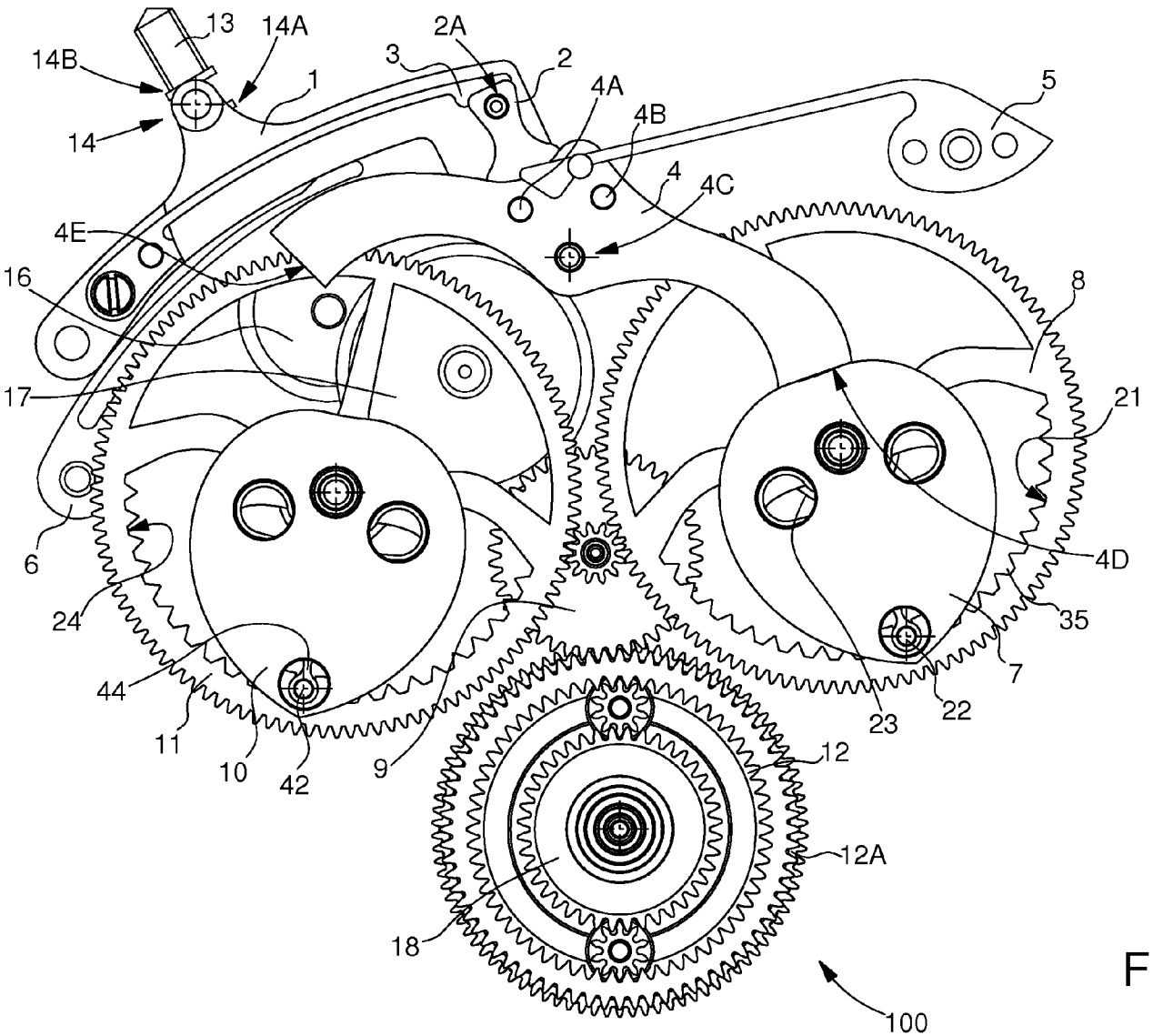
FIG. 5 shows schematically in a partial plan view, the mechanism of FIG. 4.
Figure 6:
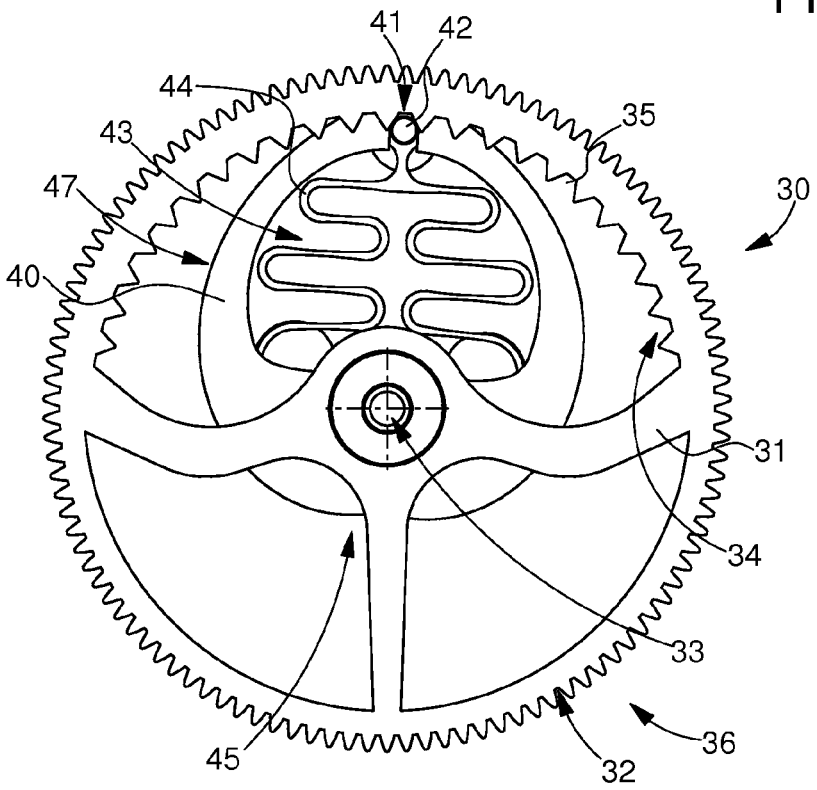
FIG. 6 shows schematically in a plan view, a memory wheel comprised in the mechanism of FIGS. 4 and 5.

According to the invention, memory wheel 30 includes a heart-piece 40, which is reversibly movable by pivoting between indexing positions of wheel 31. Preferably, as seen in FIG. 6, where wheel 31 is a toothed wheel, heart-piece 40, is movable by pivoting relative to wheel 31 about axis of rotation 33, between indexing positions 34 of toothed wheel 31. Heart-piece 40 includes indexing means, particularly an indexing finger-piece 41, via which it can cooperate with the indexing positions 34, one at a time. This indexing finger-piece 41, made in particular in the form of a pin 42, as seen in FIGS. 4 to 6, is returned radially by resilient return means 43, particularly by a spring 44, towards indexing positions 34. It is clear that, depending upon the particular case, the resilient return means 43 can work in compression, as in the example of FIG. 6, or in traction as in FIG. 7.

Figure 7:
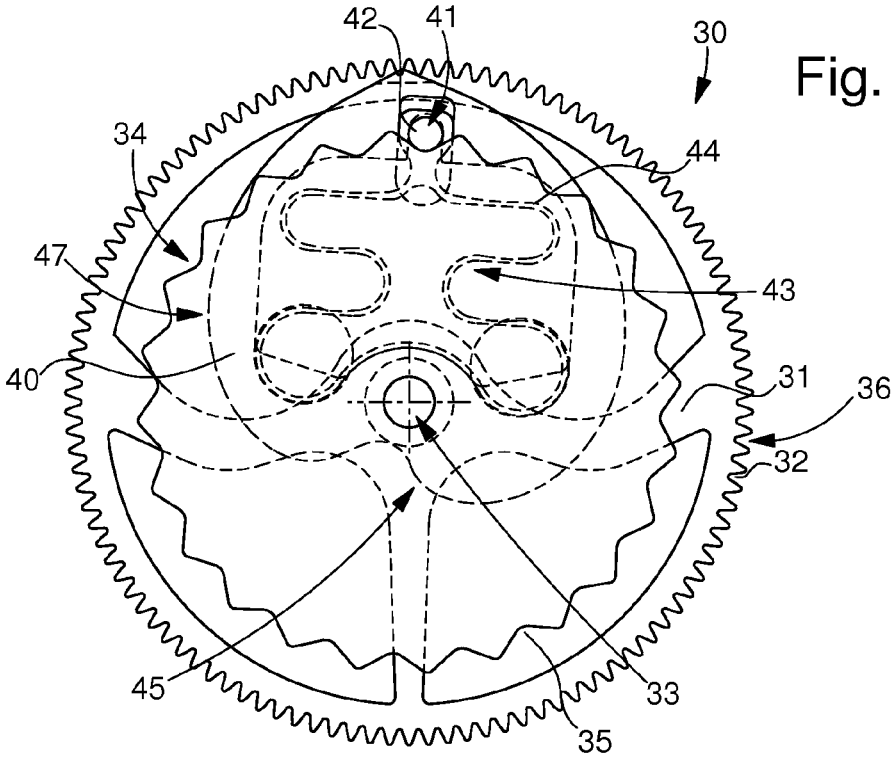
FIG. 7 shows schematically in a plan view, another variant of the memory wheel according to the invention.

Heart-piece 40 includes at least one support surface 45, which is arranged for cooperating with a complementary surface of a mechanism incorporating memory wheel 30. Preferably, in a section of heart-piece 40 perpendicular to axis of rotation 43, this support surface 45 matches the part of the peripheral surface of heart-piece 40 that is closest to axis of rotation 43. In a first variant shown in FIGS. 6 and 8 to 10, this support surface 45 is substantially flat and substantially perpendicular to a radial line originating from axis of rotation 33. In a second preferred variant, shown in FIGS. 7 and 11 to 15, support surface 45 has a substantially symmetrical female V-shaped profile relative to said radial line. It is therefore clear that this support surface 45 can perform a drive function, when the antagonistic means are also arranged to perform a dual support and drive function. The remainder of periphery 47 of heart-piece 40 advantageously has an ovoid or cardioid cam profile, which is not necessarily symmetrical as FIG. 7 shows.

Preferably, the indexing positions 34 are formed by notches 35 distributed over a sector centred on axis of rotation 33.

For a particular preferred application, relating to the time display in different time zones, there are 24 equidistant notches 35.

In an alternative embodiment, indexing positions 34 are distributed over a complete circle.

In a particular embodiment visible in FIG. 6, notches 35 are open towards axis of rotation 33.

In another embodiment seen in FIG. 7, notches 35 are, conversely, open towards the periphery of wheel 31. Spring 44 stresses pin 42 in the direction of centre 33, the two toothed wheels are integral and heart-piece 40 can rotate when pin 42 passes a notch 35. It is clear in fact that, to reduce manufacturing costs, it may be advantageous to make only external cuts, for a toothing 32 and for indexing notches 35. Wheel 31 is then advantageously stepped, or even in two parts applied to each other.

Notches 35 are preferably equidistant.

Notches 35 are made with slopes or curvatures on either side of a central hollow part forming the receptacle for indexing finger-piece 41. Thus, the latter can slide or roll from one notch to another, under the effect of tangential force applied by wheel 31, provided that the radial component of the reaction of the wall of notch 35 to this force is greater than and in the opposite direction to the centrifugal or centripetal return force, exerted by resilient return means 43, notably a spring 44.

It is clear that the mechanical memory achieved by positioning indexing finger 41 in a particular notch 35 can easily be reprogrammed, since finger 41 only needs to be moved towards another notch 35 to store another setting, as will be explained below.

It is, hence, possible to devise a timepiece mechanism incorporating at least one memory wheel 30 of this type. Preferably, according to the invention, this timepiece mechanism includes support means 50 arranged for cooperating, in a disconnectable manner, with support surface 45 of each memory wheel 30 comprised in the timepiece mechanism. The limit on the number of memory wheels is set by the space available in the case of the timepiece mechanism and by the desired functions.

Preferably, in the application described in detail below, the timepiece mechanism includes at least two memory wheels 30, corresponding to two different time display states of the timepiece mechanism. FIGS. 4, 5 and 8 to 16 illustrate the particular and preferred case of a mechanism with two memory wheels. However, it is clear that other applications may also be envisaged, without departing from the invention, in particular with more than two memory wheels on the same level, preferably formed by an additional plate relative to the timepiece movement in which it is incorporated, or with several additional plates, each including several memory wheels, each additional plate then being fitted with a distinct push-button.

The user has complete freedom to programme each memory wheel 30 and to control, via mechanical action on a push-button which supplies the necessary energy, the change from one stored state to another.

The invention concerns a time zone mechanism 100, which is arranged for the on-demand and instantaneous display of the time in a particular time zone, on the main hands of a timepiece. The timepiece includes a movement, particularly with a going train, which is not shown in the Figures.

Figure 11:
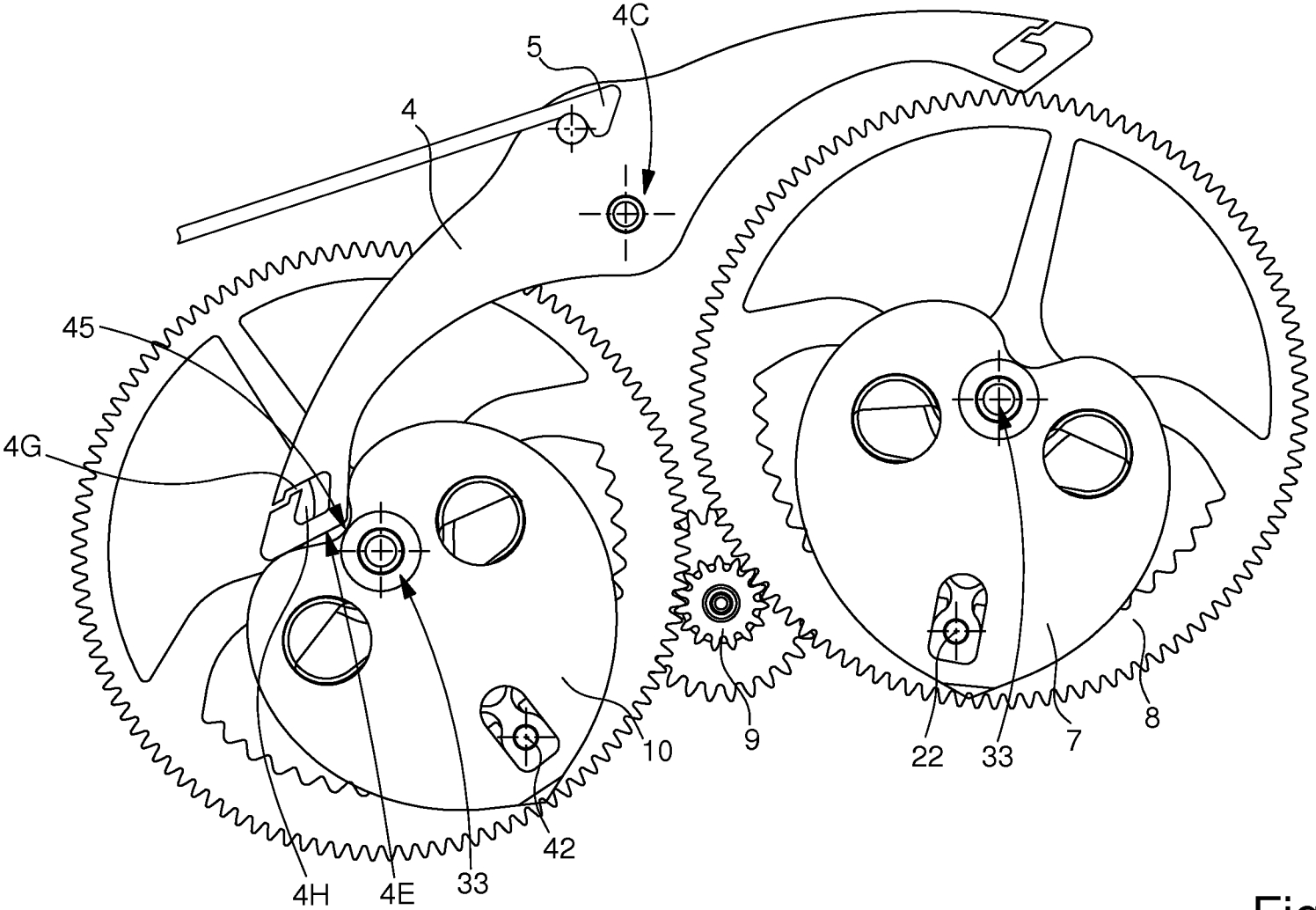
FIG. 11 shows, in a schematic partial plan view, the position of the elements of a similar mechanism to that of FIGS. 4 to 10, but with a preferred design variant of the hammer and the heart-pieces, locked onto the same London time zone.

This mechanism 100 can store the times of two localities which are preferably, but not necessarily, situated in different time zones, as shown in FIG. 11, but only one of the two time zones is displayed on the main hands. The time that is displayed is then the time zone of the location which is displayed or etched on a city disc 60, which appears in a window 66, at 6 o'clock in the example of FIG. 1. A 24 hour disc 65 indicates whether it is day or night in the selected time zone city. The date is also indicated by a date disc 64, which appears in a window 67, at 12 o'clock in the example of FIG. 1.

Let us recall that standard time is the legal time for each country, determined by local law and based on the theoretical division of the Earth's surface into 24 time zones, each of 15 degrees longitude, with certain deviations due to borders or decisions of the authorities. The user generally compares the standard time of the place where he is located to that of another place.

According to the invention, mechanism 100 includes, as seen in FIGS. 4, 5 and 8 to 16, a memory mechanism, a display state change mechanism, and a differential mechanism.

The memory mechanism includes two programmable and reprogrammable memory wheels 30, of the type described above, whose function will be explained below.

The display state change mechanism includes support means 50 arranged to cooperate disconnectably with a support surface 45 of the heart-piece 40 of each memory wheel 30. Between two actions of the user, this support means 50 connectably cooperates with the support surface 45 of one of memory wheels 30, and is disconnected from the support surface 45 of the other of said two memory wheels 30.

In this particular embodiment with two memory discs 30 according to the invention, in the absence of any action by the user, support means 50 of the timepiece mechanism connectably cooperates with support surface 45 of one of memory wheels 30 and is disconnected from the support surface 45 of the other memory wheel 30.

The differential mechanism includes a differential gear 12 with two inputs and one output. This differential gear 12 is preferably located at the centre of the timepiece movement which incorporates time zone mechanism 100. A first input is formed by a motion work wheel set arranged to be driven by the basic timepiece movement, in particular by the going train thereof. A second input is formed by a crown 12A of said differential gear 12. The output consists of a pipe, a cannon-pinion 18 or an arbour carrying an hour hand 25. Each of memory wheels 30 cooperates via the drive means 36 thereof, either directly or indirectly via at least one intermediate wheel set 9, with differential crown 12A. When wheel 31 includes a toothing 32, the latter meshes with the differential crown 12A or with an intermediate wheel set 9, which in turn meshes with said crown.

A push-button 28 is arranged for actuating a lever 1 via an application of pressure by the user. This push-button 28 is preferably formed by a crown-push button on a time zone stem 13, shown at 8 o'clock in FIG. 1. Push button 28 can also be integrated in the time-setting crown of the timepiece. The operation of the push-button in its two positions will be seen in detail in the following description:

- neutral position, selection of the stored time zone, change from one time zone to the other via the push-button;
- correction by adjusting the selected time zone, stem pulled out.

This lever 1 is permanently returned to an original starting position by a lever spring 6. Lever 1 carries a navette 2, pivoting about a navette pivotal axis 2A, which is returned to an original position under the action of a compensator spring 3. Navette 2 is arranged to cooperate by abutting on one or other of the two pins 4A or 4B integral with a hammer 4.

Figure 8:
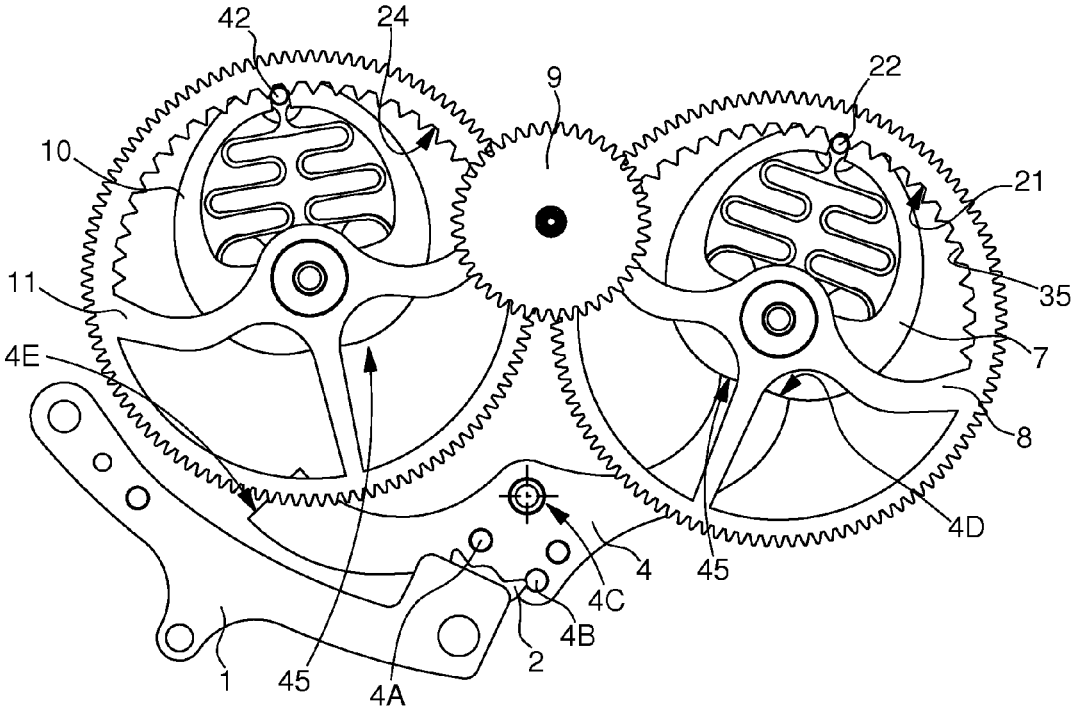
FIG. 8 shows schematically in a bottom view, the mechanism of FIGS. 4 and 5, with the hammer in a first position abutting on a first heart-piece comprised in the mechanism.
Figure 9:
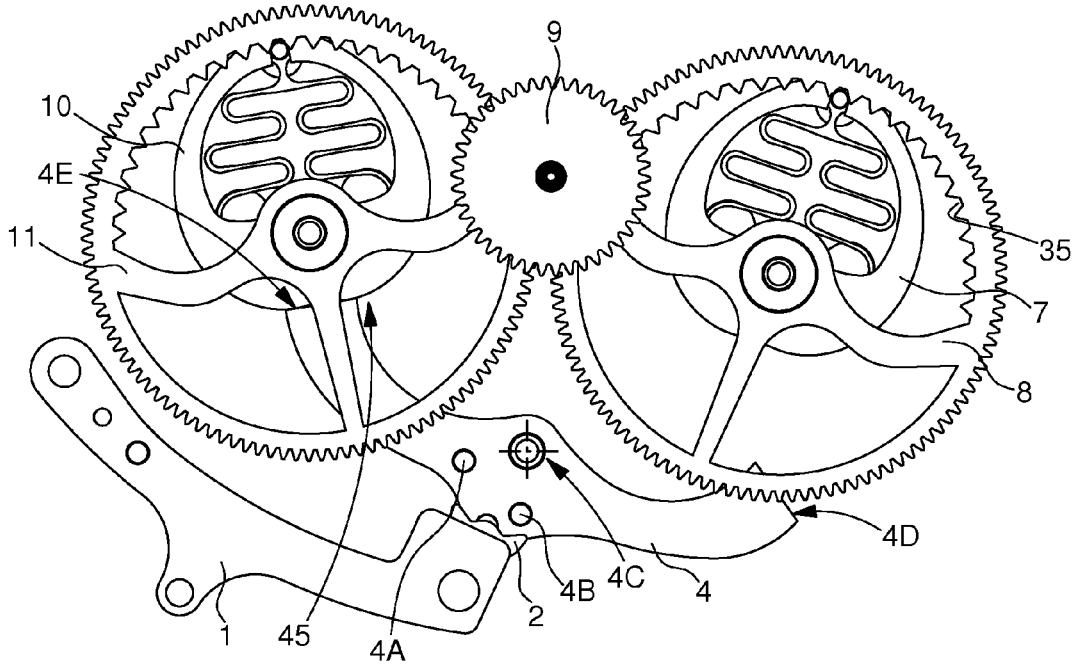
FIG. 9 shows schematically in a bottom view, similar to FIG. 8, the same hammer in a second position abutting on a second heart-piece comprised in the mechanism.

In an advantageous embodiment, support means 50 which acts on the heart-pieces of the memory wheels is formed by said hammer 4, which is arranged to pivot about a pivotal axis 4C between two positions, one abutting on support surface 45 of heart-piece 40 of one of memory wheels 30, and the other abutting on support surface 45 of heart-piece 40 of the other memory wheel 30. Preferably, navette 2 abuts on one of pins 4A, 4B by a fork type or similar fitting. The function of the time zone selection push button is illustrated in FIGS. 8 and 9, which show the relative positions of lever 1 with respect to pins 4A, 4B of the hammer in the end positions thereof. Navette 2 takes one or other of these pins depending upon the position of hammer 4. The abutment of navette 2 on one of the two pins thus has the effect of pivoting hammer 4 against support surface 45 of heart-piece 40 of one of memory wheels 30 and thus of pivoting the corresponding memory wheel to a position of equilibrium, with the heart-piece and the corresponding wheel pivoting together. The change in position of hammer 4 therefore results in the selection of the memory wheel used at a given time.

Hammer 4 includes support faces 4D and 4E for cooperating with support surface 45 of each memory wheel. In a first variant shown in FIGS. 4, 5 and 8 to 10, these support faces 4D and 4E are flat. In a second preferred variant, seen in FIGS. 11 to 15, the support faces 4D and 4E have a male V-shaped profile for cooperating with the female V-shaped profile of each support surface 45. Advantageously in this second variant, the ends of hammer 4 that include support faces 4D and 4E possess elasticity provided by a slot 4G possibly extended by a hole 4H.

Hammer 4 preferably changes position by pivoting for reasons of reliability and compactness.

To return to the two memory wheels 30, the first is called the "reference" memory wheel 11, and is for the time display of a first time zone called the "displayed" time zone, for example the current time where the user is active, whereas the second is called the "time zone" memory wheel 8, and this is for time display of a second, particular time zone stored by the user. Each of the two memory wheels 8 and 11 can be independently adjusted to a particular time zone, one called the "displayed reference time zone", corresponding to reference memory wheel 11, and the other called the "stored time zone", corresponding to time zone memory wheel 8.

At any time, one of the two memory wheels 11, 8 is meshed, directly or indirectly via wheel set 9, with crown 12A of differential gear 12. The intermediate time zone wheel set 9 meshes with differential gear 12 which will change the hour hand 25 onto the selected time zone, which may be the "reference" or "time zone".

FIGS. 11 to 17 illustrate the variety of positions that can be occupied, on the one hand by the heart-pieces relative to the memory wheels which carry said heart-pieces, and on the other hand, by the heart-pieces in relative to each other. FIG. 11 shows two heart-pieces locked onto the same London time zone.

Figure 12:
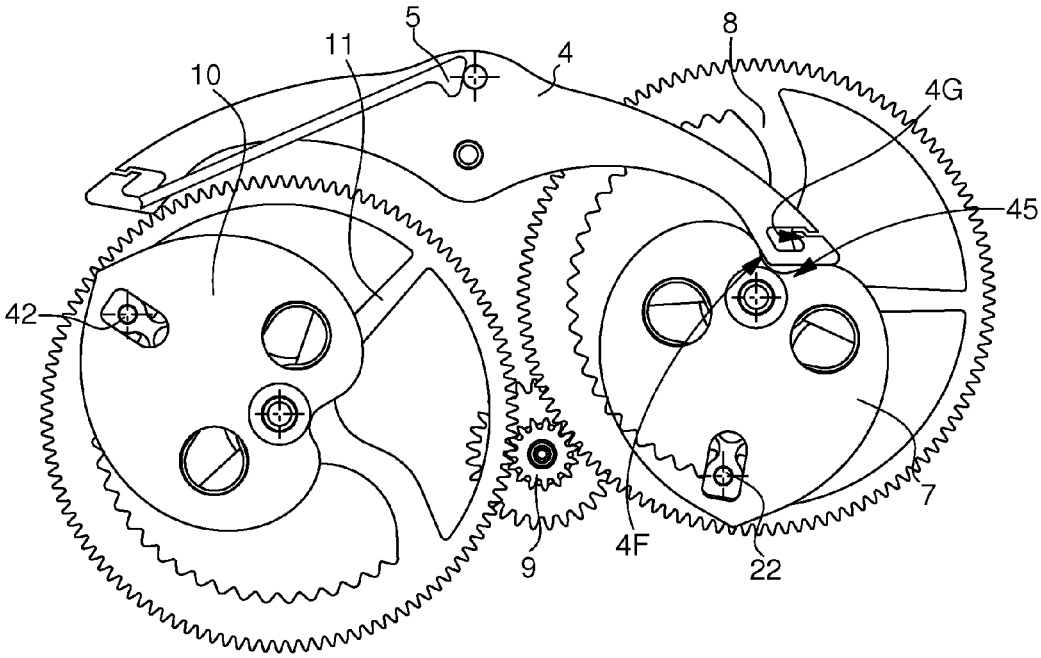
FIG. 12 shows in a schematic partial plan view, the position of the elements of the mechanism of FIG. 11, with one locked on the Midway time zone, and the other on the Wellington time zone, the first of the two being displayed.
Figure 13:
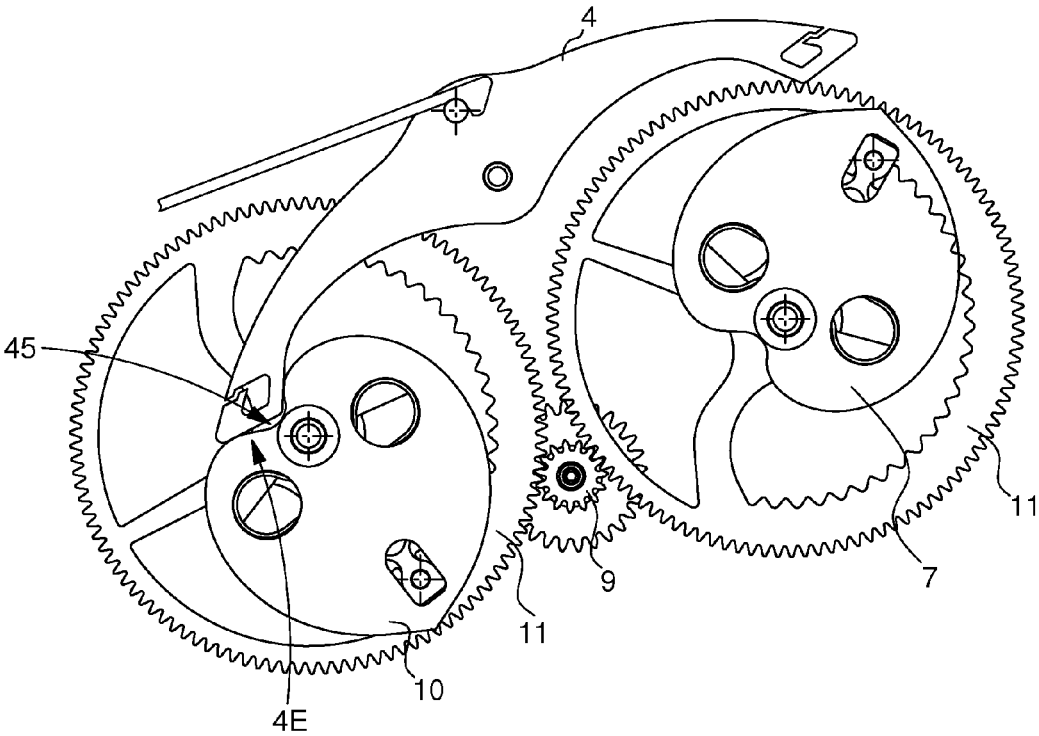
FIG. 13 shows a schematic partial plan view of the position of the elements of the mechanism of FIG. 11 with one locked on the Midway time zone, and the other on Wellington time, the second of the two being displayed.

FIG. 12 illustrates the time zone heart-piece 7 adjusted to the Midway time zone and the reference heart-piece 10 to the Wellington time zone, with the display on the Midway time zone. With the same adjustment of the heart-pieces, FIG. 13 shows the display on the Wellington time zone.

Figure 14:
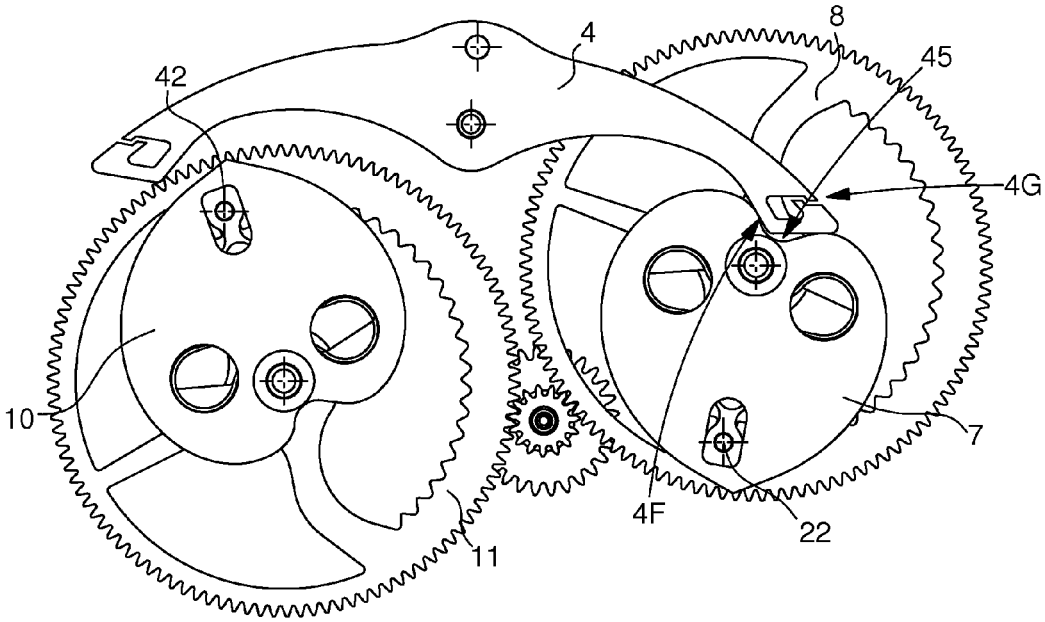
FIG. 14 shows a schematic partial plan view of the position of the elements of the mechanism of FIG. 11, with one locked on the Wellington time zone, and the other on the Midway time zone, the first of the two being displayed.
Figure 15:
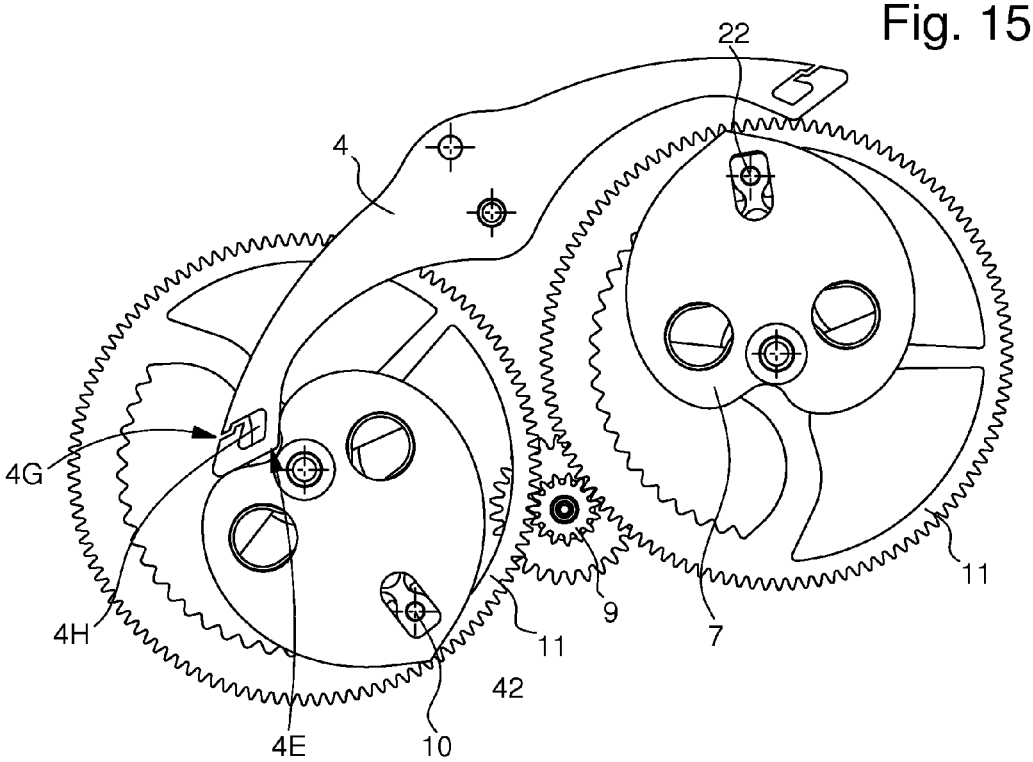
FIG. 15 shows a schematic partial plan view of the position of the elements of the mechanism of FIG. 11, with one locked on the Wellington time zone, and the other on the Midway time zone, the second of the two being displayed.

FIGS. 14 and 15 illustrate the reverse adjustments. In FIG. 14 time zone heart-piece 7 is adjusted to the Wellington time zone and reference heart-piece 10 is on the Midway time zone. With the same adjustment of the heart-pieces as in FIG. 14, FIG. 15 shows the display on the Midway time zone.

In short, when the user acts on push button 28, because of the energy transmitted by the user's application of pressure, the time zone mechanism 100 disconnects the memory wheel which was meshed, and connects the memory wheel that was not meshed, so as to transmit to output cannon-pinion 18, via differential gear 12, the position corresponding to the time display in the desired time zone. A simple application of pressure thus allows a change from the displayed time zone to the second stored time zone, and vice versa, by a second application of pressure which again displays the initial time zone.

The two memory wheels 11 and 8 are preferably driven together by an intermediate time zone wheel set 9. They rotate together until support surface 45 of heart-piece 40 of one of memory wheels 30 is cooperating in a stable manner with support means 50, in this case one of support faces 4D or 4E of hammer 4. In the position shown in FIGS. 4 and 5, it is time zone heart-piece 7 of time zone memory wheel 8 which is abutting the support face 4D of hammer 4. It is clear that, prior to action on push button 28, it is the other support face 4E of hammer 4 which was abutting on reference heart-piece 10 of reference memory wheel 11. Between the positions in which these two memory wheels are locked by hammer 4, there is therefore a phase angle difference that corresponds to the angle at which hour hand 25 pivots.

Mechanism 100 further includes a jumper spring 5, arranged to lock hammer 4, after it has pivoted, in a selected position, corresponding to the reference or stored time zone time, until the next action on push button 28 and thus on lever 1, which will trigger the cooperation between navette 2 and the other hammer pin 4A or 4B, to the one with which it was meshed before, to cause hammer 4 to pivot towards the other memory wheel 30.

In the example of the Figures, each of memory wheels 11 and 8 includes an external toothing 32 for meshing with the intermediate time zone wheel set 9, and an inner toothed sector, respectively 21 for wheel 11 and 24 for wheel 8, forming indexing positions 34. In the particular embodiment illustrated in the Figures, this inner toothing occupies a circular sector, and includes 24 inner notches 35.

Each of memory wheels 11 and 8 carries a heart-piece, respectively 10 and 7. This heart-piece is pivotably mounted on the pivotal and rotational axis of the memory wheel with which it is associated. It includes an inner chamber enclosing a spring, respectively 44, 23, forming the resilient return means 43, and on which a pin, respectively 42, 42 is mounted, forming indexing means 41, and which is movable radially relative to the rotational and pivotal axis concerned, and which is arranged to cooperate with one of the notches of the inner toothing, respectively 21, 24. It is clear that pin 42, 22 has a dual function: on the one hand displaying a time zone corresponding to one of the 24 notches of the wheel 11, 8 concerned, and on the other hand, driving with it heart-piece 10, 7 and the associated memory wheel 11, 8. The lever system is designed to lock heart-pieces 10 and 7 alternately.

When the user wishes to modify the time display from one time zone to the other, his action on push button 28, transmitted by lever 1, navette 2 and hammer 4, enables hammer 4 to pivot against the heart-piece of one of the memory wheels, and thus also to pivot the latter into the abutment position, as seen in FIGS. 4 and 5.

The reverse manoeuvre of the time display is similar: the user's action on push button 28 transmitted by lever 1, navette 2 and hammer 4, allows hammer 4 to pivot against the heart-piece of the other memory wheel and thus also to pivot said wheel.

The entire system is under stress to prevent any play in the gears.

Advantageously, time zone mechanism 100 is mounted on an additional plate superposed on the plate carrying the movement.

It is clear that mechanism 100 according to the invention may include more than two memory wheels 30, and in particular that it may include several additional plates, each associated with a plurality of memory wheels, preferably two per plate. Each plate preferably includes an independent push button.

Stem 13 is used to change the selected time zone. With the aid of different intermediate wheels 14 formed of 14A and 14B, and 15, 16, 17, as seen in FIGS. 4 and 5, and passing through the intermediate time zone wheel set 9, the two ("reference" or "time zone") memory wheels rotate. Memory wheels 8 and 11 allow two different time zones to be stored owing to their 24 inner notches 35.

Hammer 4, actuated by push button 28 moves the heart-piece and rotates one of the two memory wheels. The lever system alternately locks one heart-piece and rotates the other. The heart-piece that is locked by hammer 4 is incremented by one notch in one direction or the other, which results in a one hour increment or decrement of hour hand 25 corresponding to a time zone. The heart-piece that is not locked can rotate freely driving the associated memory wheel. Pin 42 mounted on spring 44 allows indexing of the 24 positions of the different time zones with the aid of the heart-pieces.

Figure 10:
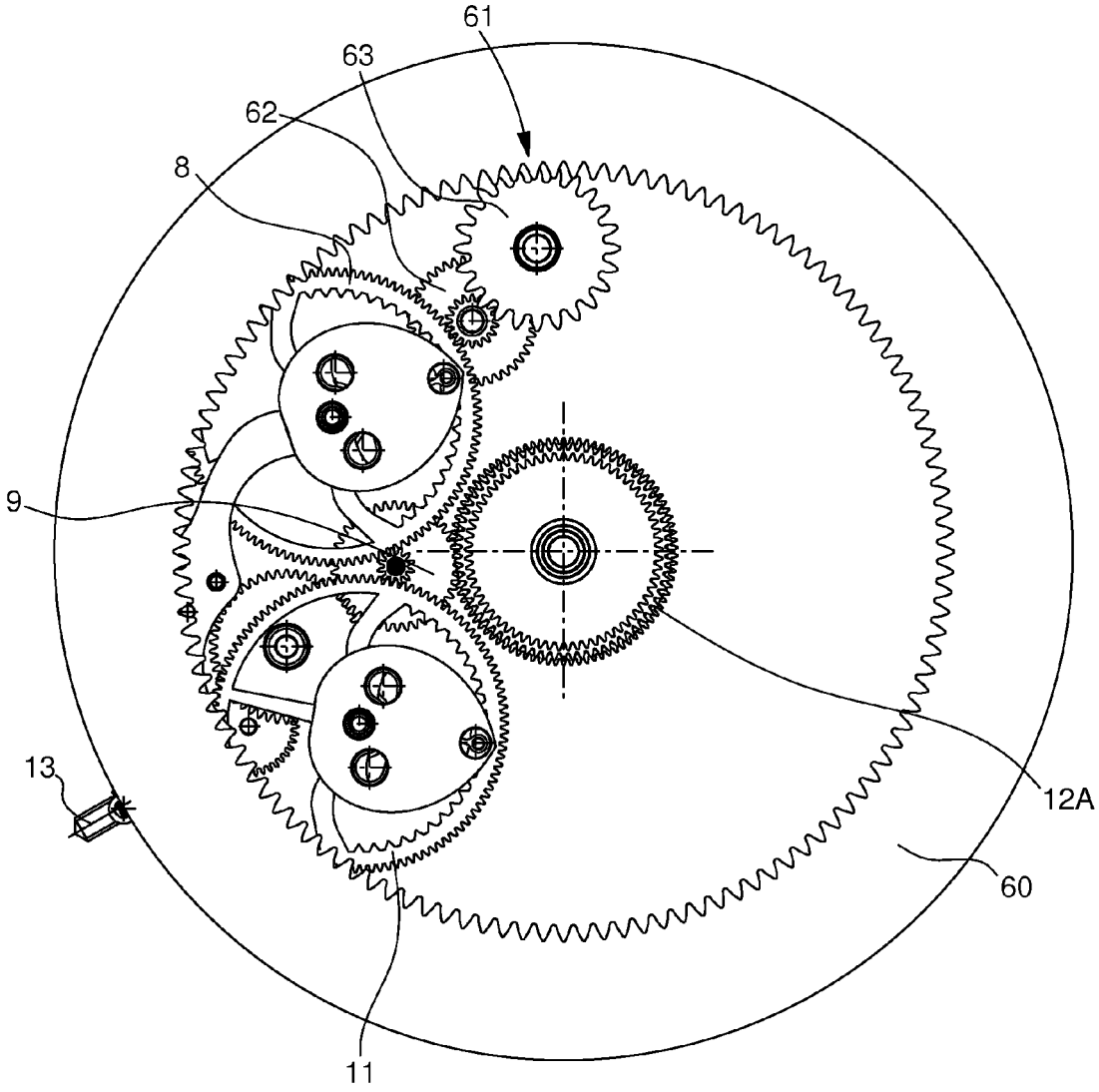
FIG. 10 shows schematically and in a plan view, the cooperation of the mechanism in the position of FIGS. 4, 5 and 8, with a city disc comprised in the time zone mechanism according to the invention.
Figure 16:
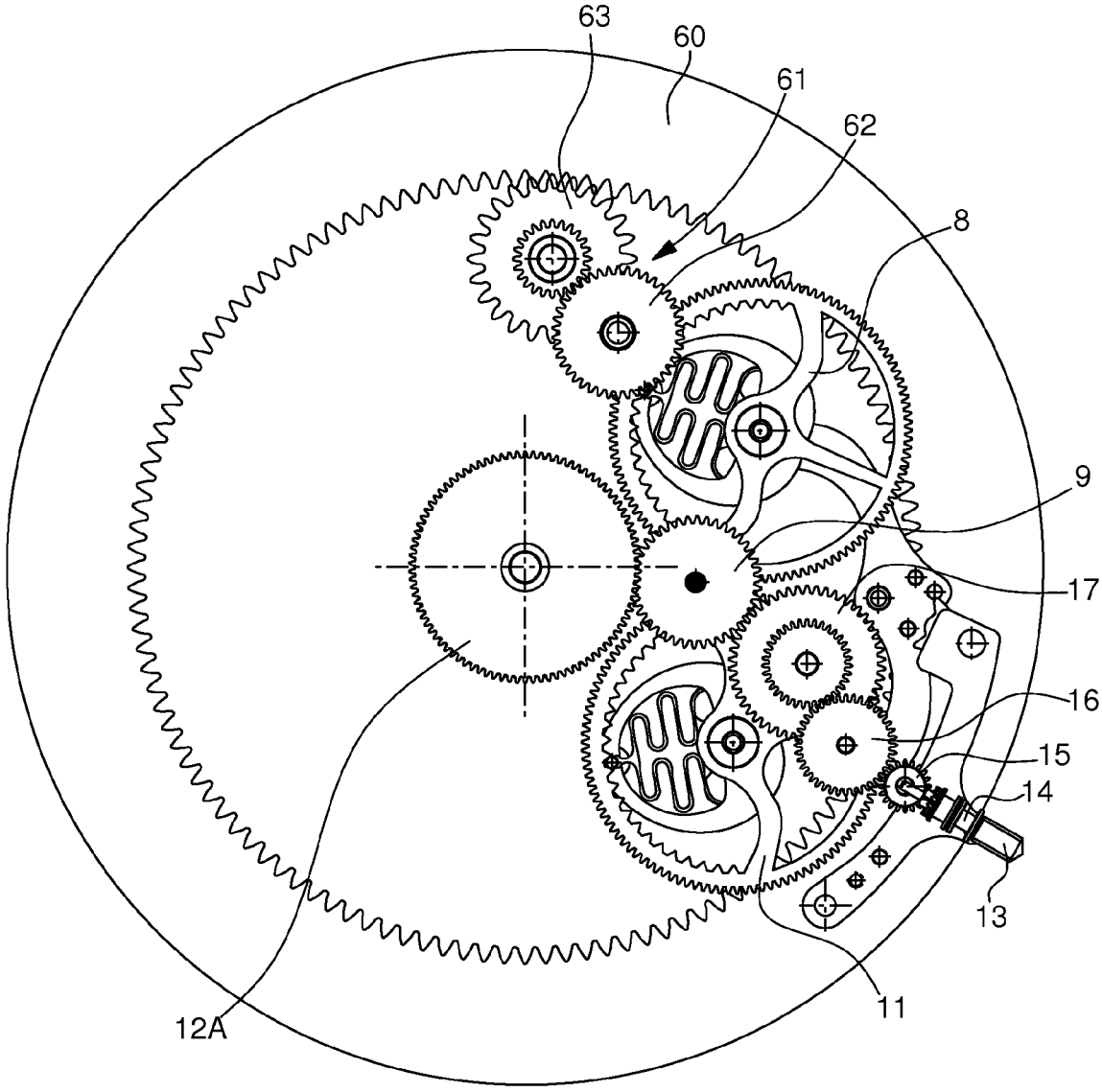
FIG. 16 shows schematically in a plan view, a time zone adjustment train according to the invention.

In a particular variant, as seen in FIGS. 1, 10 and 16, time zone mechanism 100 includes city display means linked to each time zone, notably in the form of a disc or ring 60. In the preferred embodiment illustrated in the Figures, the city disc 60 is driven, when there is a change of time zone, from the memory wheels, by a train 61 including, for example two wheels 62 and 63, wheel 62 meshing with a memory wheel 8 and wheel 63 meshing with a toothed sector of city disc 60.

As seen in FIG. 16, when the selected time zone is adjusted, with stem 13 pulled out, the memory wheels are driven by the gear train of the various intermediate wheels 14 formed of 14A and 14B, and 15, 16, 17, as shown in FIGS. 4 and 5. In the embodiment shown in FIG. 10 with memory wheels according to FIG. 6, where indexing positions 34 are distributed over a sector of limited amplitude, with notably limits at +1200 hours and −1100 hours, the device includes a security device by disconnection when the user reaches the end of travel.

Hour hand 25 makes 1/12th of a revolution per time zone, and the city disc makes 1/24th of a revolution, the reduction ratio between the two is thus 2.

When the time is being set, the selected time zone does not change. This operation, which is performed on the basic movement, has no influence on the storage of the time zones.

As regards the alternative use of two differential inputs for the time display function and time zone change or correction function, when no time zone change or correction is carried out using the push button, the differential input is locked and the hour hand is thus moved normally. When the time zone is being changed or corrected, the motion work wheel set input is considered locked, since the velocity thereof is very low, with the motion work wheel set completing one revolution in 3 hours. The hour hand will thus be moved by the time zone mechanism.

Figure 3:
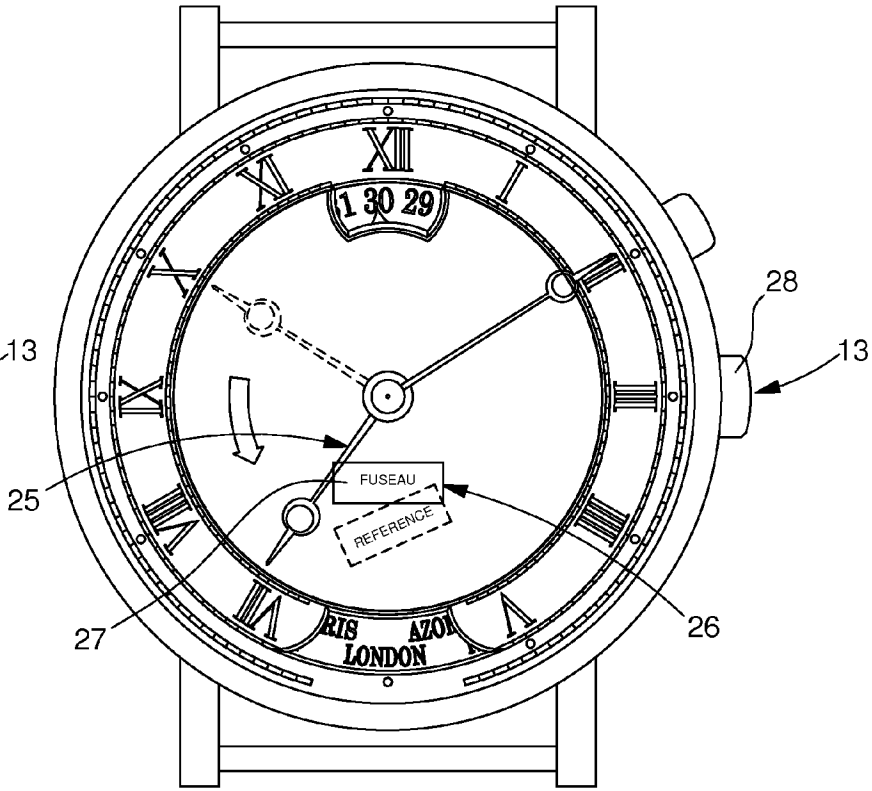
FIG. 3 shows the watch of FIG. 2, in a time zone display position called the "time zone" position.
Figure 2:
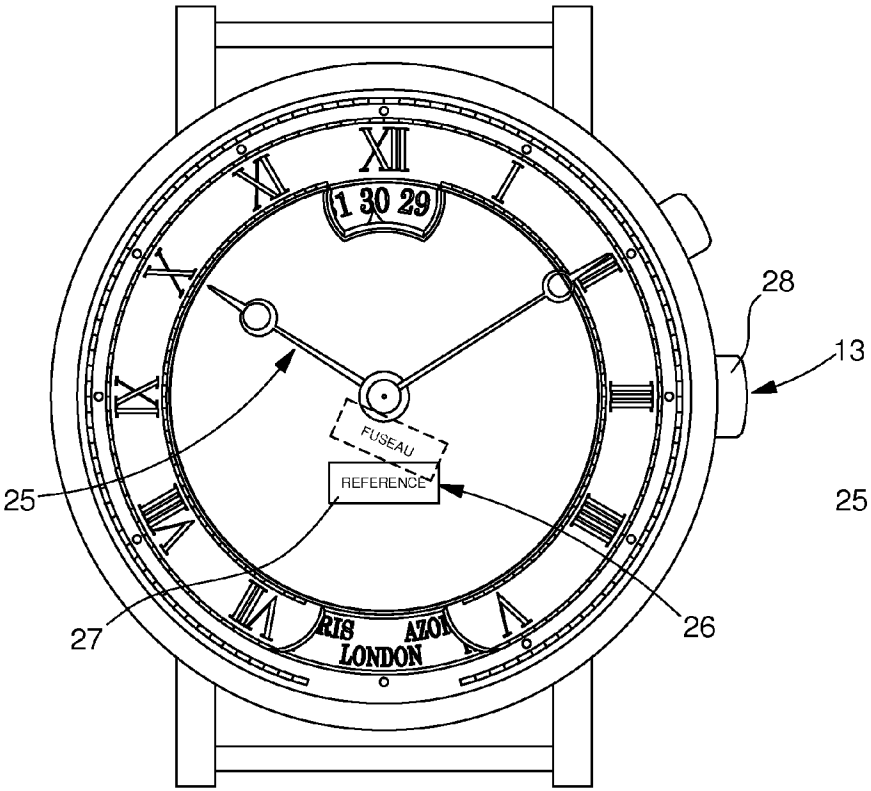
FIG. 2 shows, in a similar manner to FIG. 1, a watch incorporating a time zone mechanism according to the invention, in a second embodiment, in a time zone display position called the "reference" position.

In a second embodiment, as shown in FIGS. 2 and 3, the time zone mechanism 100 includes means displaying the state of the display, depending upon the particular case, the initial "reference" state, or the obtained state linked to a particular stored time zone. This display means is advantageously formed by a combination of a reference/time zone display window 26, through the opening of which part of a reference/time zone display support 27 is visible, such as a disc, ring or suchlike, for displaying markings such as "reference" and "time zone". Only one of these markings can be read at a time through window 26, and the change from one marking to the other occurs via the pivoting of hammer 4. This disc preferably follows the memory wheels. In a variant, one surface of hammer 4 facing the user can also form this display support 27.

In a particular variant, shown in FIG. 1, the time zone mechanism 100 includes date display means 64 linked to the particular time zone, stored by the user. Preferably, this display means 64 consists of a date disc which is driven by a gear train meshed with differential gear 12.

In a particular variant, shown in FIG. 1, the time zone mechanism 100 includes a day-night display 65 relating to the particular time zone stored by the user. Preferably, the information for this day-night display is taken from the gear train that connects differential gear 12 to date disc 64.

In a particular variant, not illustrated in the Figures, and corresponding to the particular embodiment described below, wherein the choice of time zones is made on a scale with 24 positions, the time zone mechanism 100 includes an indication for the user relating to the direction of adjustment to be applied. Indeed, in the case of a toothed, graduated sector, limited for example between +1200 hours and −1100 hours, it is convenient to know the direction in which adjustment should be made.

The invention also concerns a timepiece incorporating this type of mechanism 100.

What is claimed is:

1. A time zone mechanism, arranged for displaying, on demand, the time in a particular time zone, on the main hands of a timepiece, including a movement, the time zone mechanism comprising:

(a) at least two programmable and reprogrammable memory wheels that mechanically store user inputted settings, wherein each memory wheel includes (i) a wheel, wherein the wheel includes means for rotational driving about an axis of rotation; and (ii) a heart-piece that is reversibly movable by pivoting between at least two indexing positions of the wheel;

(b) support means arranged for disconnectably cooperating with a support surface of each of the memory wheels, and, between two actions by the user, connectably cooperating with the support surface of one of the memory wheels and being then disconnected from the support surface of the other memory wheels; and (c) a differential gear with two inputs and one output, wherein a first input is formed by a motion work wheel set, wherein the motion work wheel set is disposed to be driven by the movement, wherein a second input is formed by a crown of the differential gear, wherein the output includes a cannon-pinion or an arbour carrying an hour hand, and wherein each of the memory wheels meshes with the differential crown either directly or indirectly via the drive means.

2. The mechanism according to claim 1, wherein the heart-piece is pivotally movable relative to the wheel about the axis of rotation, between indexing positions of the wheel, with which the heart-piece is arranged to be able to cooperate via indexing means or a finger-piece comprised therein, and which is radially returned by resilient return means to the indexing positions.

3. The mechanism according to claim 1, wherein the support means are formed by a hammer arranged to pivot between at least two positions, one abutting on the support surface of the heart-piece of one of the memory wheels, and the other abutting on the support surface of the heart-piece of the other the memory wheel.

4. The mechanism according to claim 3, wherein the mechanism includes two memory wheels, and wherein the hammer is arranged to pivot between two positions, and wherein the mechanism includes a push button arranged for actuating a lever under an application of pressure by the user, the lever being permanently returned to an initial idle position by a lever spring and carrying a pivoting navette, which is returned to an original position under the action of a compensator spring, and which is arranged for cooperating with the hammer by abutting on one or other of two pins of the hammer to pivot the latter towards one of the memory wheels, the mechanism including a jumper spring arranged for locking the hammer into position after pivoting until another action of the push button, which triggers the cooperation between the navette and the other of the pins, to cause the hammer to pivot towards the other of the memory wheels.

5. The mechanism according to claim 1, wherein each of the memory wheels meshes via the external toothing thereof with the same intermediate time zone wheel set which in turn meshes with the differential crown.

6. The mechanism according to claim 1, wherein the indexing positions are formed by notches distributed over a sector centred on the axis of rotation.

7. The mechanism according to claim 1, wherein the indexing positions are formed by notches distributed over a sector centred on the axis of rotation, and the notches are equidistant and there are 24 thereof.

8. The mechanism according to claim 1, wherein the mechanism includes city display means linked to each time zone, in the form of a city disc driven, when there is a time zone change, from the memory wheels, by a gear train meshing with a toothed sector of the city disc.

9. The mechanism according to claim 1, wherein the mechanism includes display means for the date linked to a particular time zone, including a date disc, which is driven by a gear train meshed with the differential gear.

10. The mechanism according to claim 1, wherein the mechanism includes display means for the date linked to a particular time zone, consisting of a date disc, which is driven by a gear train meshed with the differential gear, and wherein it includes a day-night display relating to a particular time zone, stored by the user, wherein the information for this day-night display is taken from the gear train that connects the differential gear to the date disc.

11. The mechanism according to claim 1, wherein the mechanism includes display means including an indication for the user regarding the direction of adjustment to be applied.

12. A timepiece including a mechanism according to claim 1.

13. A timepiece including a mechanism according to claim 1, wherein the movement thereof includes a going train arranged for driving the motion work wheel set forming the first input of the differential gear.

* * * * *